United States Patent [19]

Roccaforte

[11] 4,159,765

[45] * Jul. 3, 1979

[54] DISPLAY CARTON

[75] Inventor: Harry I. Roccaforte, Western Springs, Ill.

[73] Assignee: Champion International Corporation, Stamford, Conn.

[ * ] Notice: The portion of the term of this patent subsequent to Jul. 26, 1994, has been disclaimed.

[21] Appl. No.: 891,069

[22] Filed: Mar. 29, 1978

[51] Int. Cl.[2] ..... B65D 5/50

[52] U.S. Cl. ..... 206/45.19; 206/45.14; 206/45.31

[58] Field of Search ..... 206/45.14, 45.19, 45.31; 229/16 D, 34 HW, 39 B

[56] References Cited

U.S. PATENT DOCUMENTS

| | | | |
|---|---|---|---|
| 2,321,473 | 6/1943 | Ferguson | 206/45.31 M |
| 2,617,578 | 11/1952 | Fischer | 206/45.19 X |
| 3,036,754 | 5/1962 | Kleingers, Jr. | 206/45.31 M |
| 3,233,726 | 2/1966 | Gero | 229/27 X |
| 3,584,740 | 6/1971 | Hanson | 206/45.14 |
| 3,865,233 | 2/1975 | Hamlin | 206/45.19 |
| 3,917,064 | 11/1975 | Roccaforte | 206/45.31 X |
| 3,934,719 | 1/1976 | Roccaforte | 206/45.14 |
| 4,037,717 | 7/1977 | Roccaforte | 206/45.14 |

*Primary Examiner*—Stephen Marcus
*Attorney, Agent, or Firm*—Evelyn M. Sommer

[57] ABSTRACT

A shadow display carton and blank for making same with top and bottom portions of a front panel in position to frame the article to be displayed, and die cut folded sections at the top and bottom of the carton to support and restrain the article away from the end panels of the carton. The die cut section of the bottom of the carton is reinforced by a foldable reinforcement panel cut from the section to prevent collapse of the bottom support under the weight of the article.

7 Claims, 13 Drawing Figures

Fig. 6.
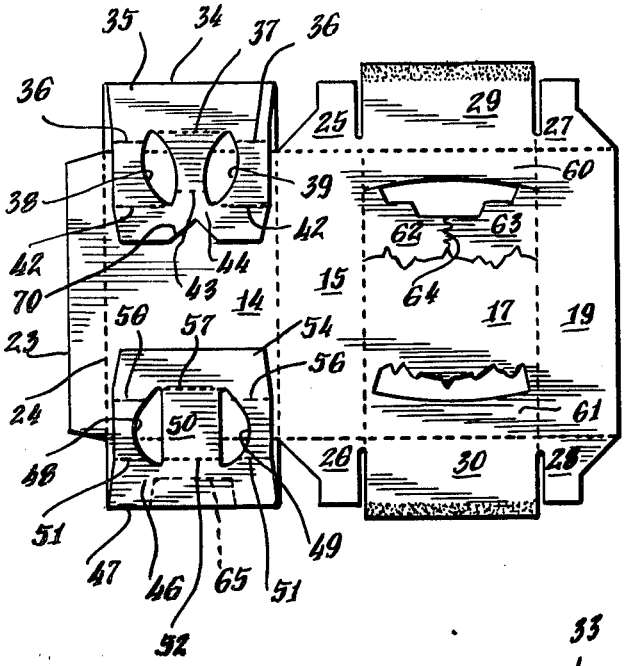
Fig. 7.
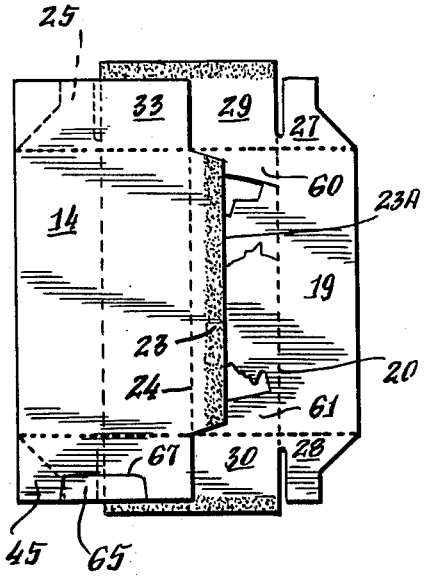
Fig. 9.
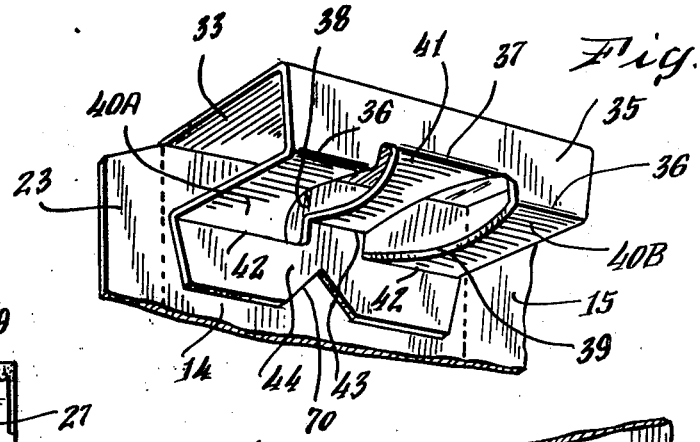
Fig. 8.
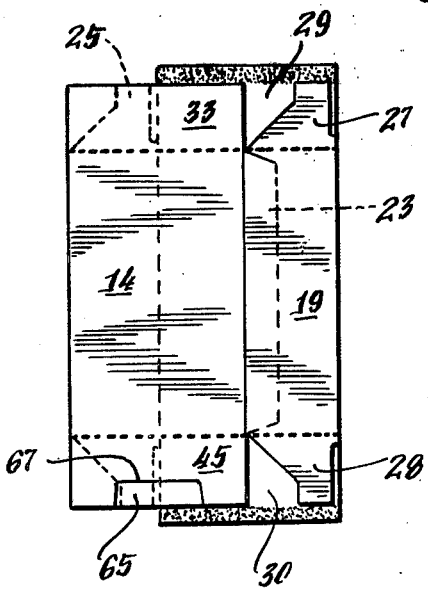
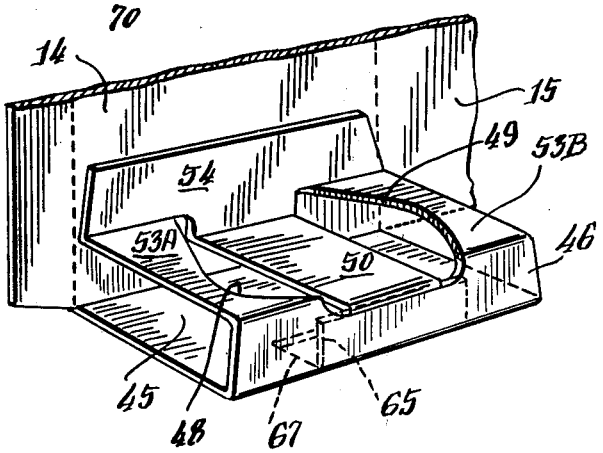
Fig. 10.

DISPLAY CARTON

BACKGROUND AND SUMMARY OF THE INVENTION

This disclosure relates to display cartons of the type having shadow panels and support structures built into the end flaps which are foldable to cushion and restrain the ends of an article to be displayed.

Most display cartons for small objects such as pharmaceuticals or cosmetics which are of the shadow panel variety are hand loaded and closed. There is a need for a carton style which will restrain and protect a glass bottle to reduce damage during shipment and storage while at the same time being attractive on the retailer's shelf. There is also a need for such a carton which can be automatically erected, loaded and closed on currently available cartoning equipment.

Accordingly, in my prior U.S. Pat. No. 4,037,717, issued July 26, 1977, a carton and blank is disclosed which has a die cut front panel split down the middle to form two shadow panels with top and bottom masking panels extending across the full width of the front panel. In addition there are end flap configurations which extend from one of the two major panels and are die cut with article engaging apertures and provided with off set fold lines so that they are capable of being automatically set up and moved into position to support and restrain the cap and bottom end of the article to be displayed away from the ends of the carton with the ends of the carton being closed in a seal end configuration.

While the carton so formed is satisfactory for its intended purpose, there is a tendency for the bottom support and restraint to buckle under the weight of the article. Therefore, a reinforcing panel is cut from the bottom support and adhesively secured to a portion of the bottom support so that when the end flap is erected into its support and restraint position to form the bottom support, the support is reinforced to carry the weight of the article and prevent collapse of the support.

BRIEF DESCRIPTION OF THE DRAWINGS

Further objects and advantages of the invention will become apparent from the following description and claims and from the accompanying drawings, wherein:

FIG. 6 is a plan view of the blank shown in FIG. 5 but partially folded and glued as would typically be performed on automatic equipment;

FIG. 7 shows a plan view of the blank in FIG. 6 illustrating the next folding step;

FIG. 8 illustrates the final folded and glued position of the blank prior to loading;

FIG. 9 is a perspective view of the upper restraining structure of the carton illustrating the relationship of the various parts thereof;

FIG. 10 is a perspective view of the bottom support structure with the remainder of the carton broken away;

DETAILED DESCRIPTION OF THE PREFERRED EMBODIMENT

Figure 1:
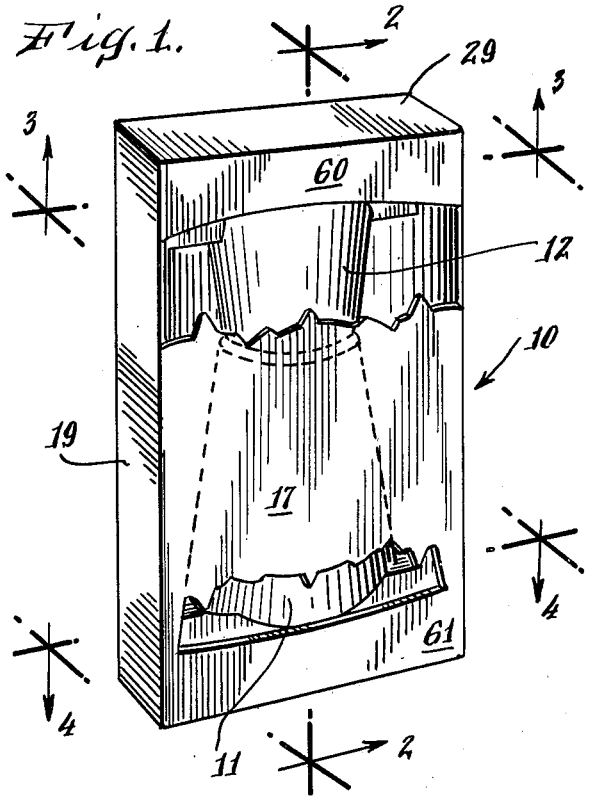
FIG. 1 is a perspective view of an assembled carton containing an article which embodies the present invention.
Figure 2:
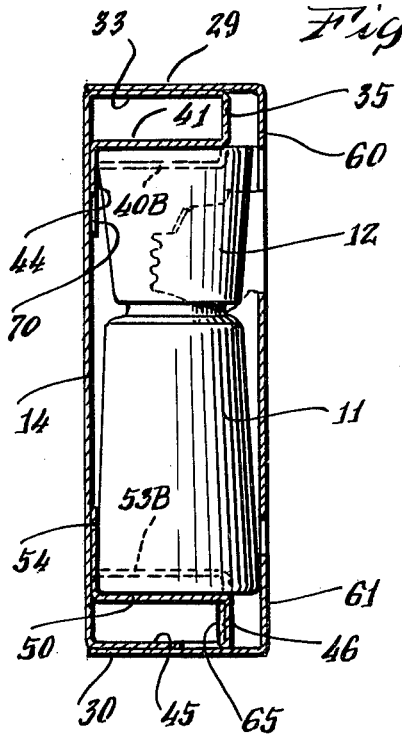
FIG. 2 is a side elevation section view of the carton and bottle of FIG. 1, taken along section lines 2—2 in FIG. 1.
Figure 3:
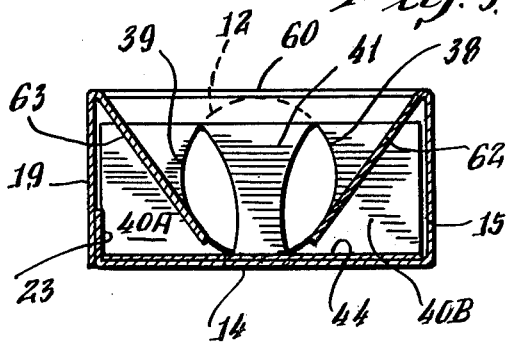
FIG. 3 is a top plan view taken in section along lines 3—3 in FIG. 1.

As previously indicated, the present invention is useful in the shipping and display of pharmaceutical or cosmetic type containers which must be attractively packaged and yet protected during shipment and storage. Accordingly, as can be seen in FIG. 1, a display carton 10 is provided to hold a bottle 11 having a cap 12 attached to the top thereof. The particular bottle 11 which is shown is shaped with an oval base which tapers inwardly to a generally circular cross section near the top. The particular cap style which is shown is provided with a larger diameter at the top than at the bottom.

Figure 5:
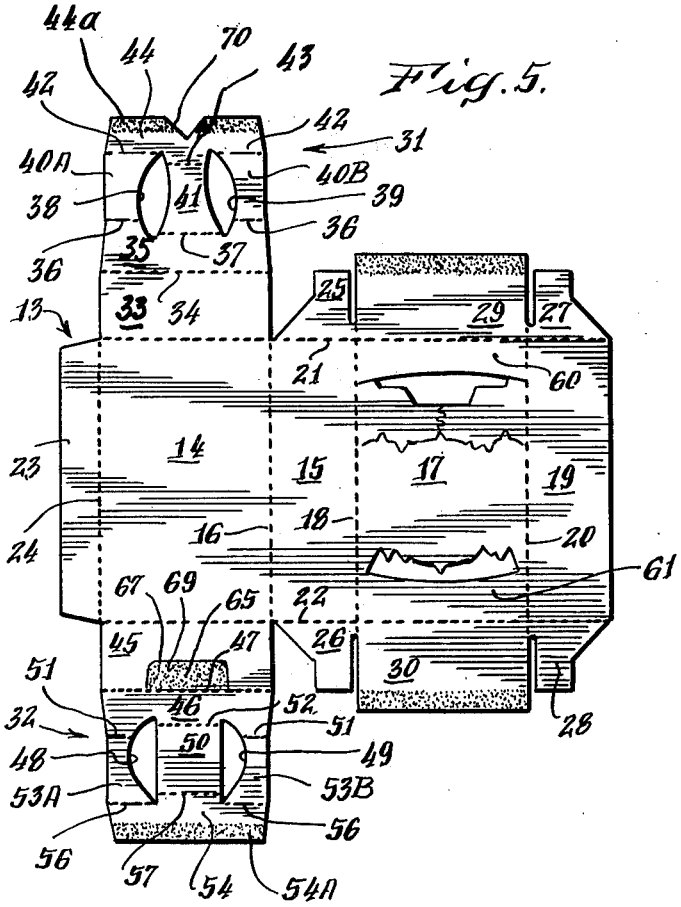
FIG. 5 is a plan view of a blank adapted to be erected into the carton such as shown in FIGS. 1 through 4.
Figure 4:
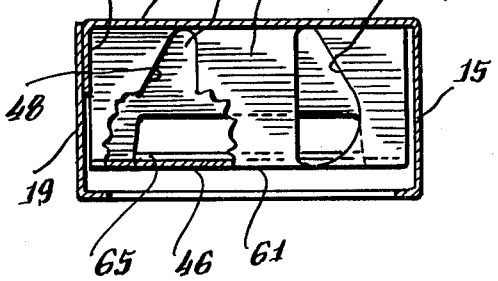
FIG. 4 is a plan view in section taken along section lines 4—4 in FIG. 1.

The carton 10 is erected from a foldable blank 13 shown in FIG. 5 which is made of foldable paperboard or similar sheet-like material and includes a back panel 14 which is rectangular in shape, an adjacent side panel 15 hingedly connected along a fold line 16, a front panel shown generally as 17 which is hingedly connected to the side panel 15 by a hinge line 18, and a second side panel 19 which is connected to the front panel by a hinge line 20. These four panels which are connected by the vertically extending hinge lines 16, 18 and 20 are defined along their top and bottom edges by parallel fold lines 21 and 22 and are foldable together into a rectangular tubular relationship which is held in place by any conventional manufacturer's joint. The particular embodiment shown in FIG. 5 includes a manufacturer's glue flap 23 which is attached to the back panel 14 along a vertical hinge line 24. The side panels 19 and 15 have end closure flaps hingedly attached at the top and bottom edges thereof along the fold lines 21 and 22 and are shown as 25, 26, 27 and 28, respectively. The front panel 17 has attached to the top and bottom thereof along fold lines 21 and 22 end closure flaps 29 and 30 which also form a part of the end closure of the finished carton.

The particular embodiment which is shown is adapted for the end closure flap 30 to be a seal and flap which is glued on top of the remaining structure as will be described later. Attached to the top edge of the back panel 14 along the fold line 21 is an upper means 31 for cushioning and restraining the bottle 11. An analagous structure is located along the bottom edge of the back panel 14 along fold line 22, and is designated 32 as means for cushioning and restraining the bottom of the bottle 11.

Upper means 31 include a first flap 33 which is rectangular in cross section and is defined along its top edge by a fold line 34. A second flap 35 is connected along hinge line 34 and is adapted to lie in vertical relationship perpendicular to the first flap 33. An intermediate restraining section is hingedly attached to the vertical flap 35 along two off-set hinge lines, 36 and 37 which are separated by two apertures 38 and 39. These apertures are die cut in the restraining section and serve to define three off-set panels, two of which lie in the same plane in the final folded position. These panels are designated as 40A and 40B as well as the third panel 41. The top edges of these restraining flaps are defined by fold lines parallel to fold lines 36 and 37 and are designated as 42 and 43, respectively. The outer portion of the upper cushioning structure 31 comprises a glue section 44 which, as can be seen, has adhesive thereon 44A. A V-shaped notch 70 is cut in flap 44 extending from the upper edge of flap 44 towards panel 41.

The relative position of these elements may be seen best in FIG. 9 where it can be seen that the first flap 33 extends outwardly from the plane of the back panel 14 and the vertical flap 35 spaces the remainder of the structure downwardly from the end of the carton. The off-set fold lines 36, 37, 42 and 43 along with the apertures 38 and 39 locate the cushioning structure which consists of the three restraining sections 40A, 40B and 41 in two different vertical planes. The whole structure is kept in place by the glue flap 44 which is in place against the inner surface of the back panel 14. The restraining section 41 serves to prevent the cap 12 from coming in contact with the end of the carton 29 and the edges of the apertures 38 and 39 prevent sideways movement of the top of the cap 12 while in the carton 10. V-shaped notch 70 acts as a funnel to guide the cap 12 against panel 41 and the edges of the apertures 38 and 39, rather than being obstructed by the thickness of panel 44.

The bottom cushioning structure 32 is similar in arrangement with the exception that the apertures are shaped in a slightly different manner to accommodate the oval lower portion of the bottle 11. A first and bottom flap 45 is hingedly attached along the bottom edge of the back panel 14 by the fold line 22. Connected thereto is a second and vertical flap 46 which is connected along the fold line 47. A rectangular reinforcement panel 65 (FIG. 5) is cut along a score line 67 in flap 45. Score line 67 has ends which terminate at fold line 47. Panel 65 is provided with an adhesive surface 69. The two apertures are numbered 48 and 49, respectively, and the center cushioning or support panel is designated 50. The off-set fold lines connecting the upright flap 46 to the cushioning and restraining structure are shown as 51 and 52 and connect not only the center panel 50 but the restraining sections 53A and 53B as well. At the opposite end, as seen in FIG. 5, the glue flap 54 is provided with a line of adhesive 54A indicated by the dotted area and it is connected along offset fold lines parallel to those at the opposite side which are designated as 56 and 57, respectively. When line of adhesive 54A is used to connect flap 54 to back panel 14 after second vertical flap 46 is folded over first vertical flap 45 about fold line 47, as shown in FIG. 6, adhesive surface 69 is secured to the inner surface of flap 46 along the fold line 52.

The bottom structure is best seen in FIG. 10 and it is obvious that the bottom portion of the bottle 11 rests upon the center section 50 and is restrained from side movement by the restraining sections 53A and 53B which have curved inner edges. The glue flap 54 is attached to the inner portion of the back panel 14 and the first flap 45 and upright flap 46 serve to complete the structure. Upright flap 46 is reinforced and stiffened by panel 65 which is adhered thereto, while the top edge of panel 65 abuts the underneath surface of supporting center section 50, precluding it from collapsing under the weight of bottle 11.

Figure 11:
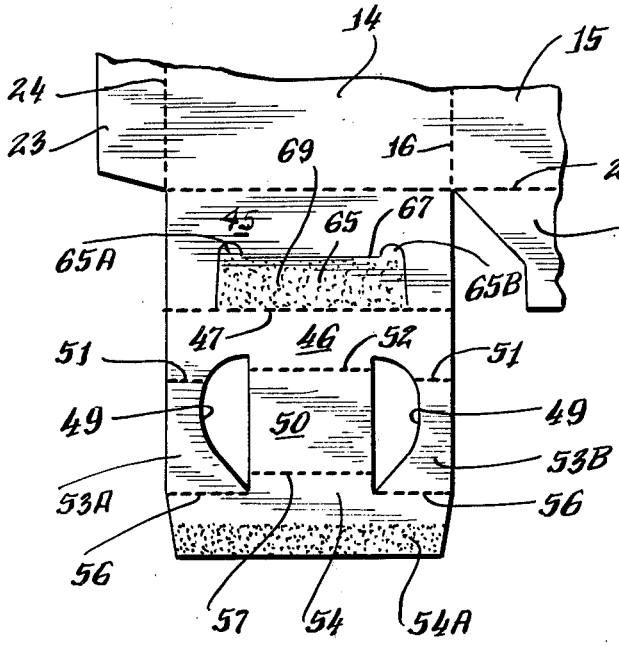
FIG. 11 is a partial plan view of a modified form of blank adapted to be erected into a carton within the scope of the present invention.
Figure 12:
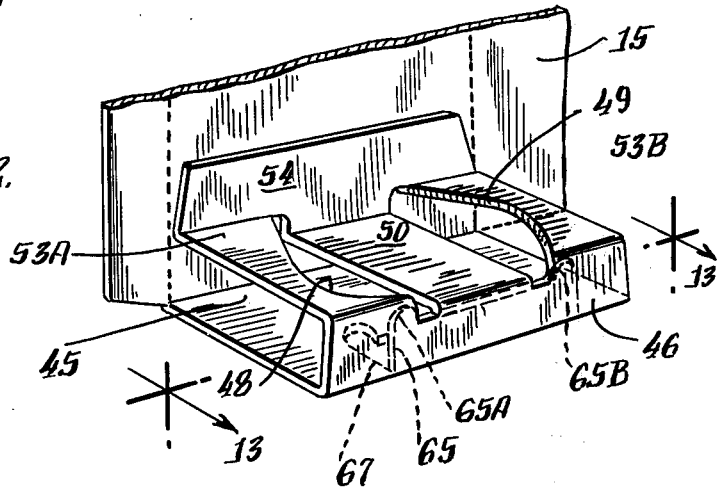
FIG. 12 is a perspective view similar to FIG. 10, but illustrating the structure utilizing the blank of FIG. 11.
Figure 13:
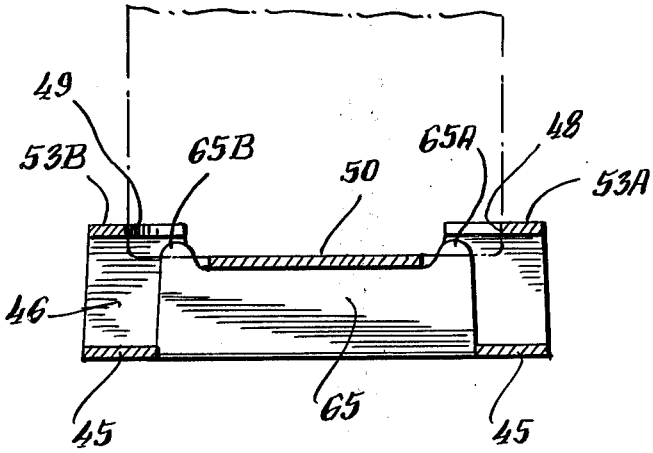
FIG. 13 is a cross-sectional view taken substantially along the plane indicated by line 13—13 of FIG. 12.

A modified embodiment of the reinforcement panel 65 is illustrated in FIGS. 11 to 13. In the blank of FIG. 11, the panel 65 is cut along score line 67 so as to provide a pair of ears 65A and 65B at opposite edges of the panel extending towards fold line 22 between panels 14 and 45.

When the panel 65 is adhesively secured to the inner surface of flap 46, as shown in FIGS. 12 and 13, the ears 65A and 65B will follow the contour of the raised and vertical edges of the apertures 48 and 49, respectively, and be disposed above the support panel 50 so that they are disposed in front of bottle 11. In the event of a jolt to the carton which may result in panel 65 separating from flap 46, the bottle 11 will hold and clamp the panel 65 in its reinforcement mode.

The front panel 17 includes an upper restraining section 60 and a lower restraining section 61 which extend across the entire width of the panel at the top and bottom and prevent the bottle 11 and cap 12 from moving outwardly after they are loaded and in position. They may serve to hold graphics or other esthetic features for the package. Two shadow panels 62 and 63 are defined in the front panel and separated by a cut line 64 down the middle.

As previously mentioned, this carton may be erected, loaded and sealed on automatic equipment. FIGS. 6 through 8 illustrate the folding which may be done on a right angle folder-gluer. The first step as shown in FIG. 5 is to apply adhesive on the areas 65, and 44A and 54A (shown in FIG. 5) of the upper and lower restraining cushioning sections 31 and 32, respectively. The sections are then folded inwardly about fold lines 34 and 47 and the adhesive patterns 65, 44A and 54A pressed into contact. FIG. 7 then illustrates how the left-hand portion of the carton 10 is folded over about the fold line 16 which is followed by application of adhesive 23A on the manufacturer's glue flap 23 followed in turn by the folding of the side panel 19 on top of the manufacturer's glue flap 23 to give the final configuration shown in FIG. 8. The carton may then be end loaded and sealed on conventional automatic equipment, thereby reducing the amount of labor required to prepare the package for shipment.

The embodiment shown has a conventional seal end or glue flap arrangement on the bottom of the carton.

What is claimed as new is:

1. A blank made of paperboard and adapted to be folded into a display carton of generally rectangular and tubular shape, comprising:

a substantially rectangular sheet of said paperboard, said sheet having opposed vertical lateral edges and opposed horizontal top and bottom edges;

four vertically spaced parallel hinge lines intermediate the lateral edges thereof defining a pair of side walls, a front panel, a back panel, and a manufacturer's glue flap positioned at one lateral edge thereof;

said side walls and said front panel having end closure flaps hingedly attached to the top and bottom edges thereof along said top and bottom horizontal edges;

said front panel having means for displaying the contents of the carton;

said back panel having a first rectangular flap hingedly attached along the bottom edge thereof;

said first flap having a bottom cushioning structure hingedly attached thereto along a horizontal fold line and a rectangular reinforcement panel cut therein along a score line whose ends terminate at said horizontal fold line;

said bottom cushioning structure having a pair of elongated apertures formed therein aligned substantially perpendicular to said bottom edge of said back panel, each of said apertures having spaced apart inner and outer lateral edges;

said structure including a second flap hingedly connected along a horizontal fold line to said first flap and defined on the opposite side by a first intermediate fold line extending between the ends of said elongated apertures as well as a first pair of colinear fold lines spaced between the lateral edges of said structures and said outer lateral edges of said apertures;

said inner lateral edges of said apertures and said first intermediate fold line together with a second intermediate fold line spaced from said first intermediate fold line defining a center support panel adapted to have said reinforcement panel abutted therebeneath;

said outer lateral edges of said apertures and said first pair of colinear fold lines together with a second pair of colinear fold lines parallel to said first pair defining a pair of restraining panels on either lateral side of said bottom cushioning structure; and a glue flap connected to said center section along said second intermediate fold line and to said restraining panels along said second pair of colinear fold lines.

2. A blank in accordance with claim 1 wherein said reinforcement panel includes a pair of ears extending upwardly from opposed corners of said panel towards said back panel.

3. A blank in accordance with claim 1 wherein said back panel has a first rectangular flap hingedly attached along the top edge thereof;

said first flap having a top cushioning structure hingedly attached thereto along a horizontal fold line, said top cushioning structure having a pair of elongated apertures formed therein aligned substantially perpendicular to said top edge of said back panel, each of said apertures having spaced apart inner and outer lateral edges:

said structure including a second flap hingedly connected along a horizontal fold line to said first flap and defined on the opposite side by a first intermediate fold line extending between the ends of said elongated apertures as well as a first pair of colinear fold lines spaced between the lateral edges of said structures and said outer lateral edges of said apertures;

said inner lateral edges of said apertures and said first intermediate fold line together with a second intermediate fold line spaced from said first intermediate fold line defining a center support panel;

said outer lateral edges of said apertures and said first pair of colinear fold lines together with a second pair of colinear fold lines parallel to said first pair defining a pair of restraining panels on either lateral side of said top cushioning structure;

a glue flap connected to said center section along said second intermediate fold line and to said restraining panels along said second pair of colinear fold lines; and a V-shaped notch cut in the center of said glue flap.

4. A display carton for a bottle, said carton having front, back and side panels arranged in a generally rectangular tubular configuration with end flaps closing the top and bottom ends thereof, said carton comprising:

a bottom cushioning structure located at the bottom of said carton and inside said bottom closure flaps, said bottom cushioning structure including a first flap hingedly connected to said back panel along the bottom edge thereof and lying on the inside of the bottom of the carton, a second flap hingedly connected to said first flap and oriented vertically parallel to the front panel of said carton, said second flap serving to space from said first flap a center panel extending between said front and back panels parallel to but spaced from said flap, a reinforcement panel cut from said first flap and adhesively connected to said second flap, said reinforcement panel having an upper edge in abutment with the bottom surface of said center panel to preclude collapse thereof under the weight of a bottle supported on said center panel, and two restraining sections separated from said center panel by vertically offset fold lines and spaced on either lateral side of said center section, said center section and said restraining sections spaced apart horizontally by elongated apertures extending from said front to said back of said carton; and a glue flap hingedly connected to said center section and each of said restraining sections, said glue flap arranged vertically on the inside of said back panel and adhesively attached thereto.

5. A display carton in accordance with claim 4 wherein said reinforcement panel includes a pair of ears extending upwardly from opposed corners of said panel above the upper edge thereof.

6. A display carton in accordance with claim 5 wherein an edge of each of said ears follows the contour of one of said apertures.

7. A display carton in accordance with claim 4 including:

a top cushioning structure located at the top of said carton and inside said top closure flaps, said top cushioning structure including a first flap hingedly connected to said back panel above the top edge thereof and lying on the inside of the top of the carton, a second flap hingedly connected to said first flap and oriented vertically parallel to the front panel of said carton, said second flap serving to space, from said first flap a center panel between said front and back panels parallel to but spaced from said flap, two restraining sections separated from said center panel by vertically offset fold lines and spaced on either lateral side of said center section, said center section and said restraining sections spaced apart horizontally by elongated apertures extending from said front to said back of said carton; and a glue flap hingedly connected to said center section of each of said top restraining sections, said glue flap arranged vertically on the inside of said back panel and adhesively attached thereto, said glue flap including an inverted V-shaped notch to guide a bottle into contact with said center panel between said restraining sections.

* * * * *